United States Patent [19]

Wilckens et al.

[11] 4,047,579

[45] Sept. 13, 1977

[54] SEA DRILLING JIG

[75] Inventors: Hellmut Wilckens, Emden; Helmut Wetzel, Hannover, both of Germany

[73] Assignee: Rheinstahl AG, Germany

[21] Appl. No.: 663,915

[22] Filed: Mar. 4, 1976

[30] Foreign Application Priority Data

Sept. 27, 1975 Germany ..... 2543293

[51] Int. Cl.[2] ..... E21B 15/02

[52] U.S. Cl. ..... 175/7; 166/.5; 175/213

[58] Field of Search ..... 175/7, 6, 5; 166/.5, 166/.6; 114/.5 D

[56] References Cited

U.S. PATENT DOCUMENTS

| | | | |
|---|---|---|---|
| 2,512,783 | 6/1950 | Tucker | 175/7 |
| 3,017,934 | 1/1962 | Rhodes et al. | 175/7 |
| 3,196,958 | 7/1965 | Travers et al. | 166/.5 X |
| 3,336,572 | 8/1967 | Paull et al. | 166/.5 X |
| 3,340,928 | 9/1967 | Brown | 175/7 X |
| 3,458,853 | 7/1969 | Daniels et al. | 166/.5 X |
| 3,486,555 | 12/1969 | Vincent | 175/7 X |
| 3,556,231 | 1/1971 | Henderson | 175/5 |

FOREIGN PATENT DOCUMENTS

| | | | |
|---|---|---|---|
| 1,238,341 | 7/1960 | France | 166/.5 |

*Primary Examiner*—Ernest R. Purser
*Assistant Examiner*—Richard E. Favreau
*Attorney, Agent, or Firm*—McGlew and Tuttle

[57] ABSTRACT

A sea drilling jig comprises a tool carrier ship having a hull with a drill tower mounted on the hull over a hull opening which extends downwardly into the sea below the tower. A riser head is engageble in the hull opening and it may be coupled to the hull. The riser head includes a float portion with a ballast tank and it has a vertically extending riser tube opening therethrough for accommodating a riser tube and for holding it in position relative to the tower. The riser head is detachable from the carrier ship and may be ballasted to float at a level below the ship out of the turbulence area of foul weather whenever foul weather occurs.

8 Claims, 3 Drawing Figures

SEA DRILLING JIG

FIELD AND BACKGROUND OF THE INVENTION

This invention relates in general to the construction of drilling jigs and, in particular, to a new and useful drilling ship which includes a drilling tool carrier with a drilling tower arranged over an opening in which a floatable riser head is engageable and which has means for holding the riser tube and which may be ballasted to float at a level below the carrier after it is detached in foul weather.

DESCRIPTION OF THE PRIOR ART

Drilling for oil and gas is effected in depths down to 100 m from a drilling tool carrier which is designed either as a platform deposited either on the bottom of the sea or as a mobile hoisting island. With greater water depths, semidiving bells or drill ships can be used as drilling tool carriers which are connected through a riser with the outlet of the well by means of a universal joint. In production drilling, an underwater complement is used at present, that is, several production holes are combined to an underwater station and are connected over a common riser to the production platform. With lower hoisting depths, stationary platforms can be employed. With greater water depths, for example, from 500 to 2000 m, a secured position can no longer be achieved by anchoring. Instead, the drilling tool carrier must be held with sufficient accuracy above the location of the borehole by dynamic positioning methods. Vertical movements of the drilling tool carrier can compensate for any movement of the carrier in respect to a fixed riser part and a telescopic part connected with the drilling tool carrier and riser tube through tensioners in the form of hydraulic tackles. In the case of bad weather, however, the movements of the floating drilling tool carrier, which may be a semi-submersible or a drill ship, can become so great that they can no longer be absorbed by the riser.

In order to avoid destruction, it is known to close the borehole which carries the riser with hydraulic slide valves and to draw first the drill pipe and then the riser upwardly in their entire length. The drawing and reinsertion of the drill pipe and of the riser is very time-consuming and is highly undesired in view of the high operating costs of the drilling jig.

SUMMARY OF THE INVENTION

The invention provides a drilling jig which includes a riser head which can be disengaged from the drilling tool carrier without having to draw the riser and the drill pipe upwardly through their entire length and which can be moved away from the associated carrier to a limited extent and the closing of the borehole is nevertheless prevented. With the invention, the riser is connected at its upper end to a riser head which forms with the drilling tool a carrier unit during the drilling operation and this unit may be uncoupled from the carrier whenever there is foul weather until the time that the weather clears up or blows away.

In accordance with a feature of the invention, the riser head is provided with its own drive and floatation means and thus forms with the riser a separate unit which may be coupled or uncoupled to the carrier. The riser head carries riser tensioners for compensating for the vertical movement of the drilling tool carrier. To communicate with the borehole location, the riser head has its own position finders which control the self-contained drive of the riser head over communication means, such as a computer control system.

In a further development of the invention, the riser head can be flooded and is connected through a draw gear with the stationary part of the riser or with the section of telescopic part secured on the riser. The draw gear, which can be operated mechanically or hydraulically, draws the riser head under the water surface after it has been uncoupled from the drilling tool carrier and positions it in a region in which the weather-related movement of the water can no longer appear or at least will be very low.

In order to keep the drilling tools uncoupled from the drilling jig, with the riser head uncoupled at its level, the inventive device includes a gripping and retaining device for the drilling tools. In order to avoid closing of the borehole, a scavening pump is arranged for attachment directly to the top of the riser head and this maintains the circulation of the drilling fluid so that it sucks it into the pump and returns it through the drill pipe.

Accordingly, it is an object of the invention to provide a drilling jig with a drilling tool carrier, including a riser and telescopic part, riser tensioner, drill pipe, and a drilling installation proper, wherein the riser is connected at its upper end to a riser head which forms a unit with the drilling tool carrier during the drilling operation and which can be uncoupled from the carrier in order to position it in a separated location during foul weather.

A further object of the invention is to provide a drilling jig which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENT

Figure 1:
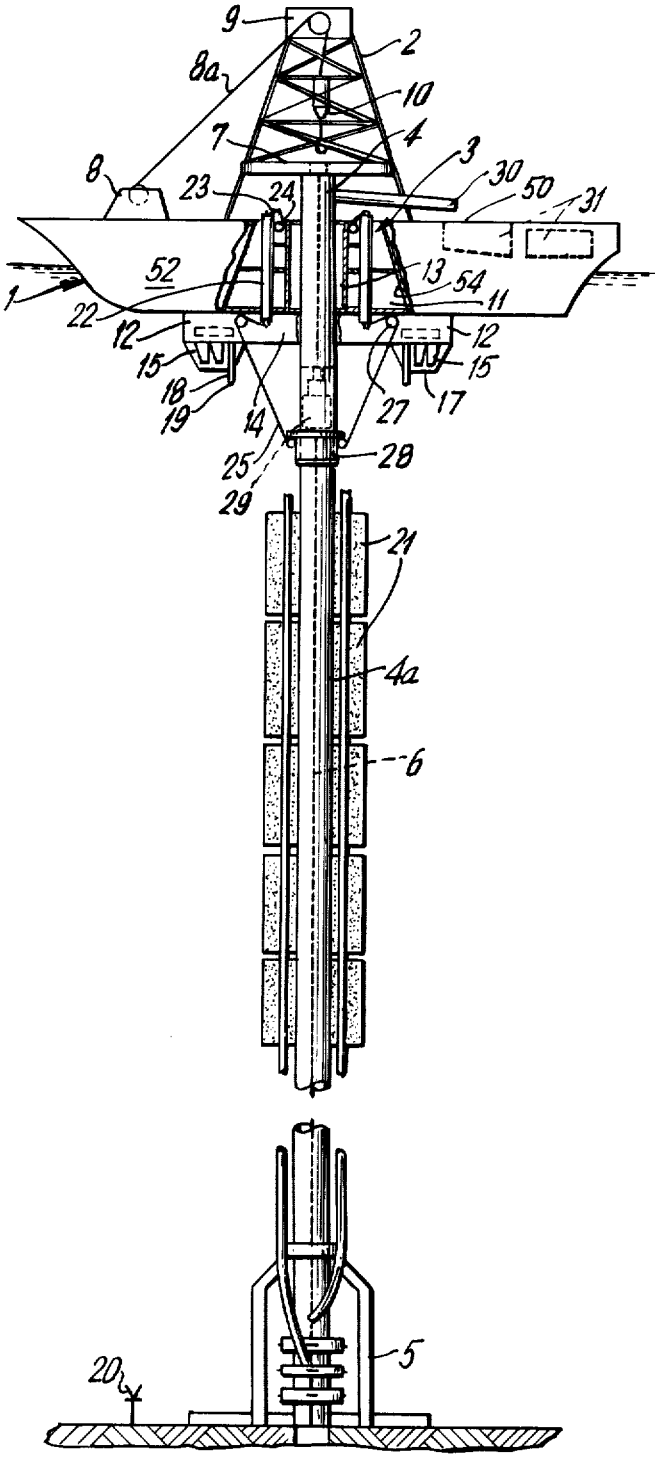
FIG. 1 is a schematic side elevational view of a drilling jig constructed in accordance with the invention, shown in an operating state.

Referring to the drawings in particular, the invention embodied therein, comprises a drilling jig which comprises a drilling ship 1 which may be either ship-shaped or of the semi-submersible type, having a drill tower 2, mounted on a weather deck 50 of the ship's hull 52 directly above an opening 4 which opens downwardly into the sea.

In accordance with the invention, drilling equipment is incorporated on a riser head structure, generally designated 3, and this includes a riser tube 4 which carries a borehole lock 5 at its lower end. A drill pipe 6 extends through riser tube 4 and it is driven at its upper end by a turntable 7 contained on the tower 2. The riser tube is lowered and drawn by a draw work mechanism 8 acting on a cable 8a which extends over a crown block 9 and is connected at its other end to a heave compensator 10.

Figure 2:
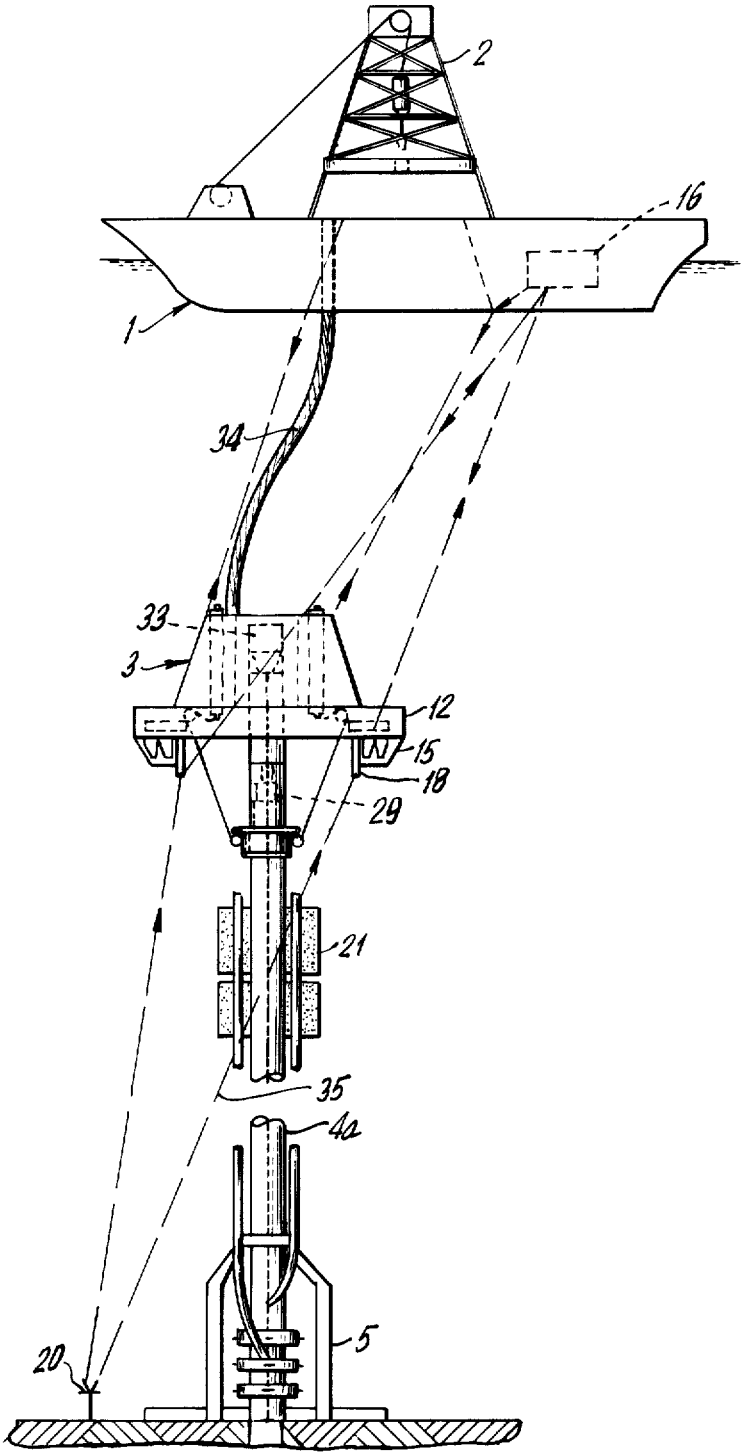
FIG. 2 is a view similar to FIG. 1 showing the jig in a standby state for foul weather.

In accordance with a feature of the invention, riser head 3 comprises a separate device which may be coupled or uncoupled from the drill ship 1. Riser head 3 includes a tower part 11 and two floats 12, 12. Tower part 11 has the form of a truncated pyramid and it fits into a similarly formed opening 54 of the hull 52. The upper portion of the pyramid is preferably provided with a circular surface. A central through hole is defined through the tower part 11 forming a moonpool 13. The floats 12 are arranged under the tower 11. The floats contain individual ballast cells or ballast tanks 14 and, in addition, they are provided with jet driving devices 15, 15 at each end. Driving devices 15 are controlled by a computer 16, as shown in FIG. 2, which is connected from the drill ship to the riser head 3. Horizontal nozzle plates 17 which are rigidly connected with the float by fastening screws or struts 18 are provided under each drive to deflect the jet into a direction in accordance with the control positioning which is required. A hydrophone 19 is arranged at the front end of each strut 18 and extends downwardly. In the extended state, the hydrophones 19 are under the nozzle plates 17 and are outside the flow field of the drives 15. Hydrophones 19 serve as receivers for a signal transmitter 20 which is installed at the drilling site. In the uncoupled state, the transit angle is measured between the signal transmitter 20 and the hydrophone 19. In addition, a relative measurement is provided between the riser head 3 and the drill ship 1 as indicated in FIG. 2.

Lifting material or floats 21 are secured on the riser 4 in a quantity to ensure that a downwardly directed residual tension remains.

Riser head 3 contains riser tensioners 22 which are arranged to absorb residual tensile forces of the riser 4. The upper end of the riser tensioners 22 is connected through dead cables 23 to the cable winches 24. Cable winches 24 are contersunk in riser head 3. At the bottom end of each tensioner 22 is arranged on active cable 25 which runs over guide rollers 27 on the bottom of the riser head 3 and engages with its free end on a collar 28. Collar 28 serves to absorb the flow forces in the sea which develop during the closing approach of the two elements as well as the tensile and compressive stresses. Riser head 3 carries rows of storage batteries (not shown) as an energy source for actuating the cable winch 24 for the riser tensioners 22.

The bottom portion of the telescopic riser part 29 is rigidly connected with the topmost portion of the multiple part riser 4. The bottom-most part of the riser is detachably connected with a swivel joint to the borehole lock 5.

Riser head 3, which is mechanically coupled with the ship in the operative position shown in FIG. 1 forms an integral part of the ship. A flow line 30 issues from the top edge of riser head 3 and forms a mud outlet opening. The mud, the drilling fluid, is pumped up by a mud pump (not shown) which is located in a preparation plant 31 on the drill ship 1.

Figure 3:
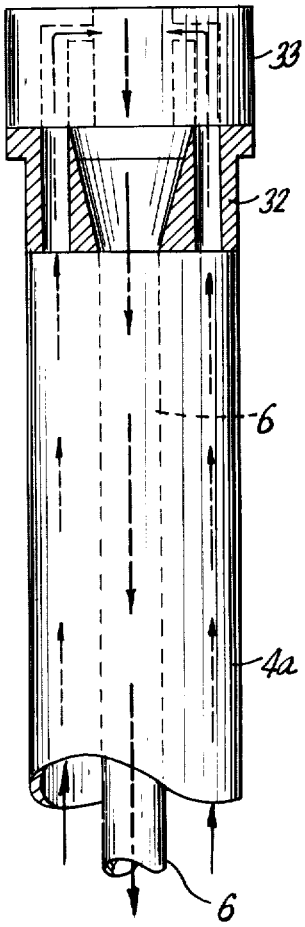
FIG. 3 is a partial sectional and elevational view of the upper end of the riser.

When bad weather approaches, riser head 3 and riser 4 are uncoupled from the ship. To effect this, drawwork 8 is operated to draw up several lengths of drill pipe 6. The upper riser piece with the outlet opening is then disassembled. A clamping device 32 is then affixed to on riser 4, as best shown in FIG. 3, and this secures the drill pipe 6 in the rise 4. A scavenging pump 33 is then attached to the device 32. The connection between riser 3 and drill ship 1 is interrupted, and the ballast cells or tanks 14 are flooded. Then the riser head 3 is pulled by means of the cable winch 24 for the riser tensioners 22 under the water surface. The telescopic part of the riser part 29 is telescoped. At the same time, a guide tube with an energy supply cable 34 is extended downwardly from drill ship 1 to the riser 3. The cable 34 which represents the only connection between riser head 3 and drill ship 1 is rewound to the point at which riser head 3 is under the water surface in position. Drill ship 1 can then move away from riser head 3 by a distance which corresponds to the length of cable 34. The motions of the sea which appear on the surface will only have a minor effect on the riser head and the mechanism supported thereby and this can be compensated with little effort. The self-contained drives 15 of the riser head may be controlled through the computer 16 of drill ship 1 in order to maintain a proper position. In the uncoupled state, the closing of the borehole is avoided by conducting the drilling fluid by means of the scavenging pump 33 through a drill pipe 6 to the borehole and then feeding it again into the space between drill pipe 6 and riser 4 to the pump.

After the weather has cleared, the riser head 3 is coupled again with the drill ship by means of electroacoustic signals 35, as shown in FIG. 2. The riser tensioners 22 are relieved again and the ballast tanks 14 are drained. After the coupling, the riser head is locked and the scavening pump 33 is removed, and the upper riser part with the outlet opening is again connected with the riser 4.

While a specific embodiment of the invention has been shown and described in detail to illustrate the application of the principles of the invention, it will be understood that the invention may be embodied otherwise without departing from such principles.

What is claimed is:

1. A sea drilling jig having foul weather rigging provisions, comprising a drilling tool carrier ship having at least one hull, a drill tower mounted on said hull, said hull having a hull opening from the interior of said hull downwardly into the sea below said tower, a riser head engageable in the hull opening for coupling to said hull, said riser head including a float portion with a ballast tank and having a vertically extending riser tube opening therethrough for receiving a riser tube therein, securement means for securing a riser tube so that it extends through said riser head opening and is secured to said riser head, said riser head being detachable from said carrier ship and self-propulsion means on said riser head for maneuvering said riser head with the riser tube secured thereto independently of the ship.

2. A sea drilling jig having foul weather rigging means, comprising a drilling tool carrier hull having an opening therein, a drill tower mounted on said hull over the hull opening, a tubular riser head engageable in the hull opening including a flow portion with a ballast tank and having a vertically extending riser tube opening therethrough for receiving a riser tube therein, means on said riser head for securing a riser tube within said tubular riser head, said riser head being detachable from said carrier hull and a jet propulsion drive carried on said riser head for the propulsion thereof.

3. A sea drilling jig having foul weather rigging provisions, comprising a drilling tool carrier ship having a hull, a drill tower mounted on said hull, said hull having a hull opening from the interior of said hull downwardly into the sea below said tower, a riser head engageable in the hull opening for coupling to said hull, said riser head including a flow portion with a ballast tank and having a vertically extending riser tube opening extending therethrough for receiving a riser tube therein, a riser tube extending through the opening, riser tube securement means carried on said riser head and connected to said riser tube for positioning said riser tube upwardly and downwardly within said tubular portion of said riser head, said riser tube securement means including a line connected between said riser tube and said riser head, and control means connected to said securement means for shifting said securement means for raising and lowering said riser tube.

4. A sea drilling jig, comprising a ship with a hull opening therethrough extending into the sea, the hull opening being substantially frusto-conical, a riser head having a substantially frusto-conical tower portion fitting into the hull opening and having a central riser head opening therethrough, a drilling tube alignable with the hull opening in said riser head, a riser tube surrounding said drilling tube and extending through the hull opening, tensioning means carried on said riser head and engaged with said riser tube intermediate its length and urging it in an upward direction under tension, said riser head being separable from the hull and being movable downwardly along said riser tube by said tensioning means to withdraw it from the bottom of said hull.

5. A sea drilling jig, according to claim 4, including ballasting means on said ship for ballasting said riser head.

6. A sea drilling jig, according to claim 5, including floatable means on said riser tube for urging it in an upward direction, tensioning means on said riser tube for urging said riser tube upwardly toward said riser head, a tower on the ship overlying the opening therein, said means for tensioning said riser tube including a cable connected to said riser tube intermediate its length and drum winding means connected to said cable for winding said cable up on said head.

7. A sea drilling jig, according to claim 4, including a cap connectable to the top of said riser tube, and an evacuation pump connected to said cap and having means for maintaining a circulation of liquid up said riser tube and downwardly through said drilling tube.

8. A sea drilling jig, according to claim 7, wherein said clamp and said pump are removable, said riser head being usable without said clamp and pump as a stabilizer for production drilling.

* * * * *